US005619880A

United States Patent [19]

Polster et al.

[11] Patent Number: 5,619,880

[45] Date of Patent: Apr. 15, 1997

[54] DEVICE FOR CONTROLLING THE ROTATIONAL SPEED OF THE ROLLS OF A ROLLING MILL

[75] Inventors: Herbert Polster; Harald Bax, both of Spardorf, Germany

[73] Assignee: Siemens Aktiengesellschaft, Munich, Germany

[21] Appl. No.: 406,991

[22] PCT Filed: Sep. 8, 1993

[86] PCT No.: PCT/DE93/00826

§ 371 Date: Mar. 29, 1995

§ 102(e) Date: Mar. 29, 1995

[87] PCT Pub. No.: WO94/07618

PCT Pub. Date: Apr. 14, 1994

[30] Foreign Application Priority Data

Sep. 29, 1992 [DE] Germany ..... 42 32 685.0

[51] Int. Cl.[6] ..... B21B 37/00

[52] U.S. Cl. ..... 72/11.4; 72/8.9; 72/9.2; 72/235; 364/571.03

[58] Field of Search ..... 72/8.9, 9.2, 11.4, 72/14.4, 29.1, 201, 227, 235; 226/42; 364/469, 571.03

[56] References Cited

U.S. PATENT DOCUMENTS

| | | | |
|---|---|---|---|
| 3,181,713 | 5/1965 | Abbe et al. . | |
| 4,099,244 | 7/1978 | Galanis et al. | 72/37 |
| 5,305,624 | 4/1994 | Backhaus | 72/8.9 |
| 5,461,894 | 10/1995 | Sorgel | 72/9.2 |

*Primary Examiner*—W. Donald Bray
*Attorney, Agent, or Firm*—Kenyon & Kenyon

[57] ABSTRACT

The rotational speed of the rolls of a rolling mill is controlled such that the loops of rolled material between two roll stands have a constant height. The last roll stand in the direction of rolling preferably acts as a guide roller stand, whose speed is controlled. The loop height is controlled by adjusting the rotational speed of the roll stand ahead of the loop.

18 Claims, 3 Drawing Sheets

DEVICE FOR CONTROLLING THE ROTATIONAL SPEED OF THE ROLLS OF A ROLLING MILL

BACKGROUND OF THE INVENTION

It is known from Japanese Patent Publications JP-A 62 207 509 and JP-A 57 130 712, from U.S. Pat. No. 3,811,304, German Patent Publication DE-A 3 012 526, and European Patent Publication EP-A 0 056 438, that in rolling mills to guide the rolled material in loops, at least between one part of the roll stand, and to control the loop height with loop controllers. The German Patent Publication No. DE-A 38 28 495 discloses using minimal draw controllers to control the tensile force feedback control in the rolled material between roll stands.

The object of the present invention is to provide a device for controlling the rotational speed of the rolls in view of the fact that a plurality of bars can be situated in the rolling train, simultaneously.

SUMMARY OF THE INVENTION

The present invention achieves the above mentioned object by providing a device for controlling a rotational speeds of roll stands of a rolling train for rolled material in the form of strips or bars, the device including control modules, a material position Cracking means and a setpoint selection means. Each of the control modules is assigned to a corresponding roll stand, adjusts the rotational speed of the roll stands, and includes a minimal draw controller and/or a loop controller for controlling a tension and/or a loop height of the rolled material between adjacent roll stands. The material position tracking means determines the positions of the rolled material within the rolling train. The setpoint selection means provides setpoint data to the control modules and includes a memory for storing a basic set of setpoint values and a set of rotational speed ratios for the successive stands in the rolling train, the basic set of setpoint values and the set of rotational speed ratios being based on rolling programs and roll data records. When the rolled materials run through the rolling train, the minimal draw controllers and loop controllers optimize sets of the rotational speed ratios and stores these optimized sets of rotational speed ratios in the setpoint selection means as the stored set of rotational speed ratios. For each bar running into the rolling train, a set of the optimized rotational speed ratios is transmitted to a setpoint memory assigned to the bar. Rotational speed ratios contained in the setpoint memories for bars situated in the rolling train are selected based on the positions of the rolled material within the rolling train as determined by the material position tracking means and supplied to the control modules.

The sets of rotational speed ratios may be made correctable by manual adjustments. For roll stands in an area of a gap between two successive bars, the optimized rotational speed ratios stored for the following of the two successive bars may be selected and supplied to the control modules for the respective stands. The last roll stand of the roll stands of the rolling train may be selected as a guiding stand having a predetermined rotational speed and the rotational speeds of the remaining roll stands may be controlled based on the optimized rotational speed ratios from the setpoint selection means.

In the case of a multi-strand rolling train having a defined multi-strand region, a last stand, in the direction of rolling, of the multi-strand region may act as a controlling stand, at least as long as a rolled material is in the multi-strand region. In the multi-strand region, rotational speeds of roll stands located, in each case, ahead of a loop in the direction of rolling may be controlled while in the single-strand region, rotational speeds of stands located, in each case, after the loop in the direction of rolling may be controlled. The direction of action of loop control of the single-strand region may be reversed after the rolled material exits from the controlling stand of the multi-strand region to allow the rotational speeds of the stands located, in each case, ahead of the loop in the direction of rolling to be controlled.

The present invention further provides a means for determining the rolled material length affecting the loop (i.e., loop elongation) or the length of the rolled material between the roll stands as an actual value and a loop controller for controlling the rotational speed of a stand adjacent to the loop so that the actual value is equal to a predetermined setpoint value.

The height of the loop is expediently used as a measure indicative of the length of the rolled material between the rolls (i.e., the loop elongation). It is advantageous to use the last stand of a rolling train (i.e., the exit stand) as a controlling stand whose rotational speed determines the output speed of the rolled material and should therefore be constant. The stands located ahead of the loop in the direction of rolling are then controlled.

DETAILED DESCRIPTION

Figure 1:
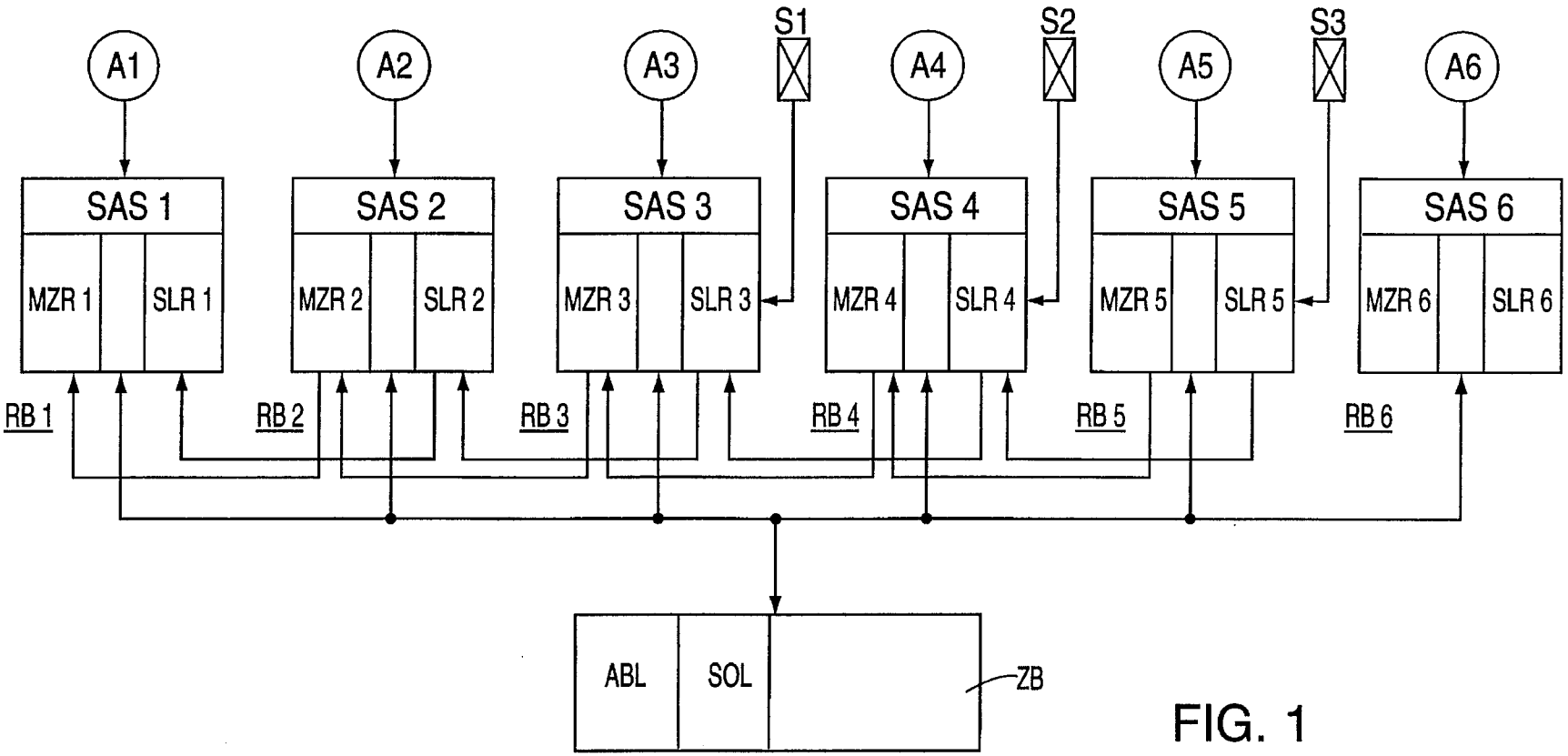
FIG. 1 is a basic circuit diagram of a rolling mill speed control.

In FIG. 1, A1 through A6 denote roll stands in which rolled material coming from a furnace is rolled. The last roll stand, A6, is used as the controlling stand whose rotational speed is specified according to the exit speed of the rolled material. The drives of the stands are controlled, so that they are supplied with setpoints from a corresponding one of control modules RB1 through RB6. These control modules can be programmed modules for example, each containing, in the notation of FIG. 1, a minimal draw controller MZR1, MZR2, MZR3, MZR4, MZR5, or MZR6 and loop a controller SLR1, SLR2, SLR3, SLR4, SLR5, or SLR6. A central module ZB contains a material position tracking means ABL, which establishes the position of the rolled material and communicates it to the individual controller modules RB1 through RB6, as well as a setpoint selection mean SOL containing, among other things, a setpoint memory assigned to the individual roll stands, so that setpoint selection means SOL can be distributed at least partially among the individual control modules RB1, RB2, RB3, RB4, RB5, and RB6.

The setpoint selection means SOL supplies the selection setpoints (which are corrected by loop controllers SLR1, SLR2, SLR3, SLR4, SLR5 or minimal draw controllers MZR1, MZR2, MZR3, MZR4, MZR5) to control modules RB1 through RB6. The minimal draw controller MZR6 and the loop controller SLR6 do not affect (i.e., modify) the control module RB6 because the rotational speed of roll stand A6 should be determined by the setpoint provided by setpoint selection means SOL alone.

In the example of the preferred embodiment, the rolled material does not move in a straight line between stands A3, A4, A5 and A6, but instead, sags or arches (i.e., forms a loop) between two roll stands. Loop height detectors S1, S2, S3 determine the height of these loops and supply loop controllers SLR3, SLR4, SLR5 with signals corresponding to the loop heights. The loop controllers SLR3, SLR4, SLR5 set the rotational speeds of stands A3, A4, A5 so that the loop heights remain constant. The loop heights must normally kept constant. This is done by acting upon the stand located ahead of the loop in the direction of rolling.

Minimal draw controllers MZR3, MZR4, MZR5 have no effect on the rotational speed of the roll stands A3, A4, A5, since the corresponding loop controllers SLR3, SLR4, SLR5 are operating. On the other hand, minimal draw controllers MZR1, MZR2 of control modules RB1, RB2, which are assigned to the first roll stands in the direction of rolling A1, A2, are released (i.e., can affect the rotational speed of the roll stands A1, A2), while the corresponding loop controllers SLR1, SLR2 are not released (i.e., have no effect on the rotational speed of the roll stands A1, A2).

While in the example of the present embodiment, the last stand A6 is used as the controlling stand, in multi-strand trains it is expedient to initially use the last stand in the multi-strand region as the controlling stand. This, however, applies only as long as the material is in contact with the multi-strand region. As long as material contact exists with the multi-strand region, the exit stand, which is the last stand in the single-strand region, becomes the controlling stand for the corresponding strands, and the direction of action of the loop controller operating in this strand is switched into the direction of the oven. Thus an increase in the exit speed caused by the drawing-in of the loops is avoided.

To determine the roll stand rotational speed setpoint, five units operate together. The material position tracking unit ABL reports that there is rolling train occupancy to minimal draw controller MZR, setpoint selector SOL and loop controller SLR. The output values of the three latter units are combined in a setpoint output SAS and forwarded to the corresponding stand drive.

Figure 2:
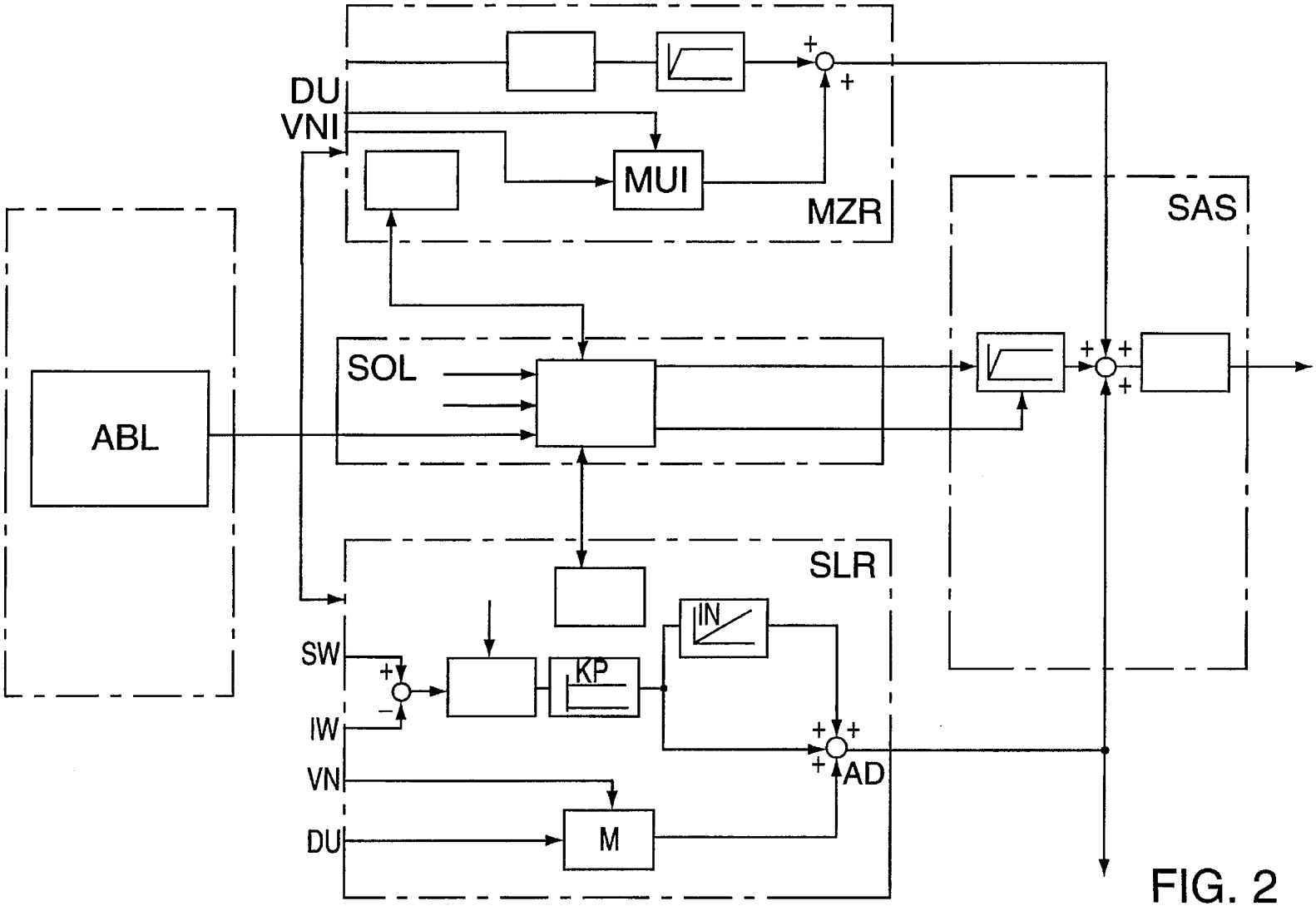
FIG. 2 is a block diagram of an arrangement for forming the setpoint of the rotational speed of a roll stand.

FIG. 2 shows the construction details and the interconnection of the material position tracking unit ABL, the minimal draw controllers MZR, the setpoint selection means SOL, the loop controllers SLR, and the setpoint outputs SAS. At the beginning of a new rolling program or a new rolling train configuration, the setpoint selection means SOL transfers the parameters required for the initial settings to loop controller SLR means. These parameters contain the operating setpoints for loop height and the values of the currently operating roller and gear transmission ratios. The input values for loop controller SLR are the actual loop height IW and the set loop height SW.

The loop controllers are configured as PI (i.e., Proportional-Integral) controllers in the exemplary embodiment. Fuzzy controllers or state controllers can also be used. Depending on the position of the rolled material, different loop height setpoints or loop elongation setpoints can be provided to the loop controllers. The loop height determined in the first pass is transferred as the initial setpoint. Based on this value, the setpoint is increased to the operating setpoint with a stipulated rate of increase. Loop controller SLR can also determine the time for switching to the operating setpoint from the status of the rolling train transmitted by material position tracking means ABL. The time for switching on an exit setpoint that decreases continuously at a given rate, which is input to reduce the loop, is given by the material position tracking means ABL directly to loop controller SLR.

A non-linear relationship exists between the loop height and the elongation of the rolled material between two roll stands due to the loop, hereinafter referred to as loop elongation. Therefore, to linearize the control circuit, the actual value of the loop height and the setpoint are converted into a loop elongation value using a curve with measured interpolation points or are recalculated with a mathematical algorithm and forwarded to the loop controller. Therefore, the actual value (i.e., the length of the rolled material between two roll stands, differing from the loop elongation by a constant additive value) is used for controlling the loop elongation. Which of the two linearization types is used depends on the rolled material, the geometric dimensions of the loop such as loop height and loop length, the arrangement of the guide rollers, as well as the type of loop (e.g., lying, standing, or hanging). In many cases, assuming that the loop is triangular is sufficient for calculating the loop elongation from the loop height SH and spacing 2a of the guide rolls delimiting the loop, so that the loop elongation can be calculated using the simple formula:

$$SV=2\cdot(a^2+SH^2)^{1/2}-2a.$$

As mentioned above, the loop controllers preferably operate with feedthrough, i.e., a loop controller also affects the drive ahead of it and the controller following it in the direction of the process. For this purpose, the output signals of the loop controller are supplied, via an input DU, to the controller following it in the direction of the process. For the feedthrough corresponding to the speed ratio to become effective, the signal supplied to input DU is multiplied in a multiplier M by a factor providing the speed ratio, which is supplied to an input VN. The output signal of multiplier MU is added to the output signals of proportional portion KP of the loop controller and integral portion TN of the loop controller in adder AD. A sum signal output by the adder AD is supplied to the setpoint output.

Due to the feedthrough, the manipulated variable of a loop controller does not have the effect of a disturbance for the preceding loop controller. As a result, the rolling train guidance is steadier. The loop controller feedthrough should only affect those stands acting upon the same bar as the stand directly affected by the loop controller. The loop controller obtains the information required for this restraint of the feedthrough from material position tracking means ABL.

The rolling program contains information about the active stands, drivers, rollers, shears, minimal draw control and loop controller. It also contains the material velocities and operating rotational speeds for the individual stands and the operating loop height setpoints. Rolling data sets contain the diameter of the current roller, forward slip factors and possibly gear transmission ratios.

When such a rolling program is started, a set of rotational speed ratios, such as the speed ratio of consecutive drives, is calculated and stored. The speed ratios are optimized during the passage of the rolled material through the loop controller SLR and minimal draw controller MZR or are corrected by manual intervention. The optimized rotational speed ratios are supplied to setpoint selection means SOL and are transferred therefrom, into the stored set of rotational speed ratios. It is assumed that a rotational speed ratio is optimized when the loop or minimal draw control has reached a steady state.

Therefore, setpoint selection means SOL always has a set of the current rotational speed ratios, which contains all the corrections made through the minimal draw control MZR, the loop controller SLR and manual control to that point.

Before a bar, as rolled material, is run into the rolling train, the selected setpoints for the individual drives are calculated from the rotational speed of the controlling stand and from the current stored rotational speed ratios. Since more than one bar may be in the train at the same time, a setpoint set is calculated and stored for each bar as it enters the rolling train. These setpoint sets remain valid until the corresponding bar exits the rolling train. Thus, for each bar in the rolling train and the following bar that enters the rolling train, the setpoint selection means SOL manages a complete set of selected setpoints for all of the drives. For example, ten setpoint sets corresponding to ten bars can be present for 32 drives. In addition to the setpoint memory for bars, the setpoint selection means SOL has an output memory for the current setpoints to be selected. Depending on the material in the rolling train, the corresponding drive values are selected from the bar setpoint memories, transferred to the output memory and supplied to setpoint output SAS.

Figure 3:
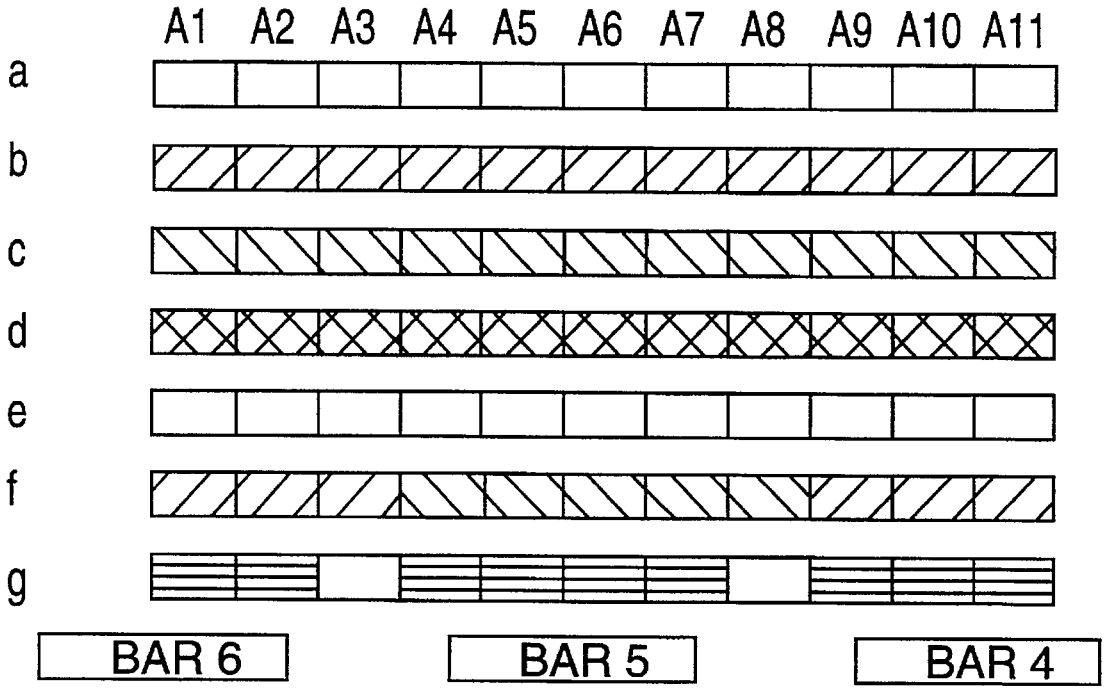
FIG. 3 illustrates the contents of a setpoint memory control.

FIG. 3 illustrates the fact that setpoint sets are calculated for each bar entering the train using the example of a rolling train with eleven roll stands A1 through A11. For each of these roll stands, setpoints are stored; together, these stored setpoints constitute a basic setpoint set shown in line a. Double lines in line g show the presence of material in the rolling train at a given point in time. A bar 4 is at the exit of stand All, which may be the controlling stand, and is also in the region of stands A9, A10. A bar 5 is in the region of stands A4, A5, A6, A7, and an incoming bar 6 is in the region of stands A1, A2. The basic setpoint set (a) was optimized due to the previous bars 1 through 3, and the optimized values were entered in a setpoint memory for bar 4. The setpoint set for bar 4 is represented in line b. Lines c, d, and e illustrate the setpoint memories for bar 5, bar 6, and the following incoming bar, respectively. Line f shows the content of the output memory of setpoint selection means SOL.

For stands in the region of bar 4, the respective setpoints are taken from the setpoint memory for bar 4 (line b). For stands A4, A5, A6, A7, which are in the region of bar 5, setpoints are entered from the setpoint memory for bar 5 (line c). Since the information is entered during the bar gap (i.e., a gap between adjacent bars), at the point in time shown, the setpoint for bar 5 is also written in the output memory for stand A8. Correspondingly, the setpoints for bar 6 (line d) are written in the output memories for stands A1, A2, A3. As the bars pass through the rolling train, the corresponding regions for the setpoints also travel through the output memory (line f) of the setpoint selection means.

Setpoints are sent from the setpoint selection means SOL to the setpoint output SAS when the rolled material enters the rolling train or when a new rolling program is adopted, as well as in the gaps between bars and after manual corrections. The rotational speed setpoints are transferred to loop controller SLR and to minimal draw controller MZR at the same time, except in the case of manual corrections. The setpoint selection means SOL determines the time for selecting the setpoint in the bar gap from the information concerning the material in the rolling train communicated by material position tracking module ABL. Providing the setpoint in the bar gap has the effect of avoiding any influence on active minimal draw adjustments and loop adjustments.

The equipment of the roll stands, e.g., the gear reduction ratios and the roller diameters, can be modified based on rolling program changes. This also entails a change in the system gain, which in turn must be accounted for in the control parameter KP. A normalizing factor FKN is introduced for control technology considerations to avoid the need for changing the KP value obtained. This FKN factor is used to adapt the control to the modified equipment, e.g., gear reduction ratio and roller diameter.

This automatic controller adjustment causes the optimum loop controller setting to be maintained in all rolling programs in the case of system parameter changes, dictated, for example, by the rolling program.

We claim:

1. A device for controlling rotational speeds of roll stands of a rolling train for rolled material forming a loop between two roll stands, comprising:

a) a device for determining at least one of a rolled material length affecting the loop and a length of the rolled material between the two roll stands, as an actual value;

b) a loop controller for controlling the rotational speed of a roll stand adjacent to the loop such that the actual value is equal to a predetermined setpoint value; and c) a setpoint memory, in which, as a bar is processed, the rotational speed of the controlling stand and rotational speed ratios of the roll stands are stored, said setpoint memory providing said stored rotational speed of the controlling stand and said rotational speed ratios of the roll stands as setpoints for each new bar entering the train, wherein the rotational speeds of each of the roll stands of the rolling train for each new bar entering the train are calculated from said rotational speed of the controlling stand and said rotational speed ratios of the roll stands provided by said setpoint memory, the calculated rotational speeds being used to control the roll stands prior to the entry of the new bar into the rolling train.

2. The device of claim 1 wherein the device for determining includes:

a loop height sensor, arranged between the two roll stands, for determining a loop height; and a computing circuit for converting the loop height into the rolled material length.

3. The device of claim 2, wherein the computing circuit stores a curve from which a corresponding rolled material length is determined from the loop height.

4. The device of claim 2 wherein the computing circuit computes the rolled material length from the loop height.

5. The device of claim 4 wherein the computing circuit computes the rolled material length according to the formula:

$$SV=2\cdot(a^2+SH^2)^{1/2}-2a,$$

where $2a$ is defined as a distance between the two roll stands delimiting the loop and SH is defined as the loop height.

6. The device of claim 1 wherein the loop controller controls the rotational speed of a roll stand located ahead of the loop in a direction of rolling.

7. The device of claim 6 wherein rotational speeds of other roll stands, located in a region of a same rolled material, are changed in the same proportion as the rotational speed of the controlled roll stand.

8. The device of claim 6 wherein the last roll stand in the direction of rolling is a guiding stand having a predetermined rotational speed.

9. The device of claim 6 wherein, in the case of a multi-stand rolling train, the last roll stand of a multi-strand region in the direction of rolling is assigned as a controlling stand at least as long as the rolled material is in the multi-strand region, and, in the multi-strand region, the rotational speeds of the rolling stands located ahead of the loop in the direction of rolling are controlled and in the single-strand region of the rolled material, the rotational speeds of rolling stands located after the loop in a direction of rolling are controlled, and the direction of action of the loop controller is reversed after the rolled material exits from the controlling stand of the multi-strand region so that the rotational speeds of the rolling stands located ahead of the loop in the direction of rolling are controlled.

10. The device of claim 1 wherein, in the case of a controller with a parameter dependent on the equipment, the parameter is multiplied by a standardization factor considering the corresponding roll stand equipment.

11. The device of claim 10 wherein the parameter is an amplification factor.

12. The device of claim 10 wherein the parameter is a gear reduction ratio of the rolling train.

13. The device of claim 10 wherein the parameter is a roller diameter of the rolling train.

14. A device for controlling a rotational speeds of roll stands of a rolling train for rolled material in the form of strips or bars, the device comprising:

a) control modules, each being assigned to a corresponding roll stand, for adjusting the rotational speed of the roll stands, each of the control modules including at least one of a minimal draw controller or a loop controllers for controlling a tension or a loop height of the rolled material between adjacent roll stands;

b) a material position tracking means for determining the positions of the rolled material within the rolling train;

c) a setpoint selection means for providing setpoint data to the control modules, the setpoint selection means including a memory for storing a basic set of setpoint values and a set of rotational speed ratios for the successive stands in the rolling train, the basic set of setpoint values and the set of rotational speed ratios being based on rolling programs and roll data records;

wherein, when the rolled materials run through the rolling train, the minimal draw controllers and loop controllers optimize sets of the rotational speed ratios and stores these optimized sets of rotational speed ratios in the setpoint selection means as the stored set of rotational speed ratios, wherein for each bar running into the rolling train, a set of the optimized rotational speed ratios is transmitted to a setpoint memory assigned to the bar, and wherein rotational speed ratios contained in the setpoint memories for bars situated in the rolling train are selected based on the positions of the rolled material within the rolling train determined by the material position tracking means and supplied to the control modules.

15. The device of claim 14 wherein the sets of rotational speed ratios are correctable by manual adjustments.

16. The device of claim 14 wherein for roll stands in an area of a gap between two successive bars, the optimized rotational speed ratios stored for the following of the two successive bars are selected and supplied to the control modules for the respective stands.

17. The device of claim 14 wherein the last roll stand of the roll stands of the rolling train is selected as a guiding stand having a predetermined rotational speed, and wherein the rotational speeds of the remaining roll stands are controlled based on the optimized rotational speed ratios from the setpoint selection means.

18. The device of claim 14 wherein, in the case of a multi-strand rolling train having a defined multi-strand region, a last stand, in the direction of rolling, of the multi-strand region acts as a controlling stand at least as long as a rolled material is in the multi-strand region, wherein, in the multi-strand region, rotational speeds of roll stands located, in each case, ahead of a loop in the direction of rolling are controlled, wherein, in the single-strand region, rotational speeds of stands located, in each case, after the loop in the direction of rolling are controlled, and wherein the direction of action of loop control of the single-strand region is reversed after the rolled material exits from the controlling stand of the multi-strand region to allow the rotational speeds of the stands located, in each case, ahead of the loop in the direction of rolling to be controlled.

* * * * *